US007831180B2

(12) United States Patent
Toh et al.

(10) Patent No.: US 7,831,180 B2
(45) Date of Patent: Nov. 9, 2010

(54) TONER AGITATOR

(75) Inventors: Cher Lek Toh, Choa Chu Kang Crescent (SG); Sandeep Kumar Arya, Northvale (SG)

(73) Assignee: Dell Products L.P., Round Rock, TX (US)

( * ) Notice: Subject to any disclaimer, the term of this patent is extended or adjusted under 35 U.S.C. 154(b) by 434 days.

(21) Appl. No.: 11/940,760

(22) Filed: Nov. 15, 2007

(65) Prior Publication Data

US 2009/0129822 A1 May 21, 2009

(51) Int. Cl.
*G03G 15/08* (2006.01)

(52) U.S. Cl. ..... 399/254; 399/261; 399/262

(58) Field of Classification Search ..... 399/254, 399/255, 258, 261, 262
See application file for complete search history.

(56) References Cited

U.S. PATENT DOCUMENTS 5,940,664 A 8/1999 Sugihara et al.
6,088,556 A * 7/2000 Nagasaki et al. ..... 399/120
6,215,974 B1 * 4/2001 Katoh et al. ..... 399/258
6,337,956 B1 1/2002 Sato et al.
6,405,010 B2 6/2002 Ashikari et al.
6,526,246 B2 * 2/2003 Iwata et al. ..... 399/258
6,567,635 B2 5/2003 Livadas et al.
6,892,036 B2 * 5/2005 Ito ..... 399/27
2002/0159795 A1 10/2002 Bessette
2004/0179866 A1 * 9/2004 Muramatsu et al. ..... 399/258

FOREIGN PATENT DOCUMENTS

GB 2421320 A 6/2006
JP 2003170576 A 6/2003

OTHER PUBLICATIONS

Office Action issued in corresponding Singapore Patent Application No. 200802579-3, Jan. 9, 2009.

* cited by examiner

*Primary Examiner*—David M Gray
*Assistant Examiner*—Joseph S Wong
(74) *Attorney, Agent, or Firm*—Haynes and Boone, LLP

(57) ABSTRACT

A printer includes a toner cartridge coupling section. A toner agitation member is located adjacent the toner cartridge coupling section and is operable to engage a surface of a toner cartridge when the toner cartridge is located in the toner cartridge coupling section. An actuator is operable to actuate the toner agitation member.

20 Claims, 11 Drawing Sheets

TONER AGITATOR

BACKGROUND

The present disclosure relates generally to information handling systems, and more particularly to a toner agitator for a printer that may be connected to an information handling system.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

It is often desirable to couple a printer to an IHS in order to print documents, images, and a variety of other printed matter known in the art. Some printers such as, for example, laser printers, include toner cartridges that hold the toner used to create the printed matter. Sometimes, the performance of the printer may suffer due to, for example, uneven flow of the toner inside the toner cartridge that may prevent the toner from being provided to the printer to allow printing. As a result, the toner cartridge may be discarded before the toner has been used up.

One solution used to achieve the full yield of the toner in the toner cartridge is to remove the toner cartridge from the printer and shake it. This solution is undesirable due to the need for human intervention, the subjective nature of such intervention, and the risk of toner spillage during the intervention. In addition, many users are unaware or uncomfortable with performing such a solution and instead replace the toner cartridge, resulting in a waste of available toner.

Another solution to this problem is to provide a mechanism that is internal to the toner cartridge to agitate the toner. However, this may require a relatively large toner cartridge and, due to the clearance required for the flow of the toner within the toner cartridge as well as the coagulation tendencies of toner, substantial toner may be remain within the toner cartridge even after operation of the mechanism. As such, it may still be required that the toner cartridge be removed from the printer and shaken in order to achieve the full yield of the toner in the toner cartridge, resulting in the problems mentioned above.

Accordingly, it would be desirable to provide an improved toner agitator for a printer.

SUMMARY

According to one embodiment, a printer includes a toner cartridge coupling section; a toner agitation member located adjacent the toner cartridge coupling section, wherein the toner agitation member is operable to engage a surface of a toner cartridge when the toner cartridge is located in the toner cartridge coupling section; and an actuator that is operable to actuate the toner agitation member.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
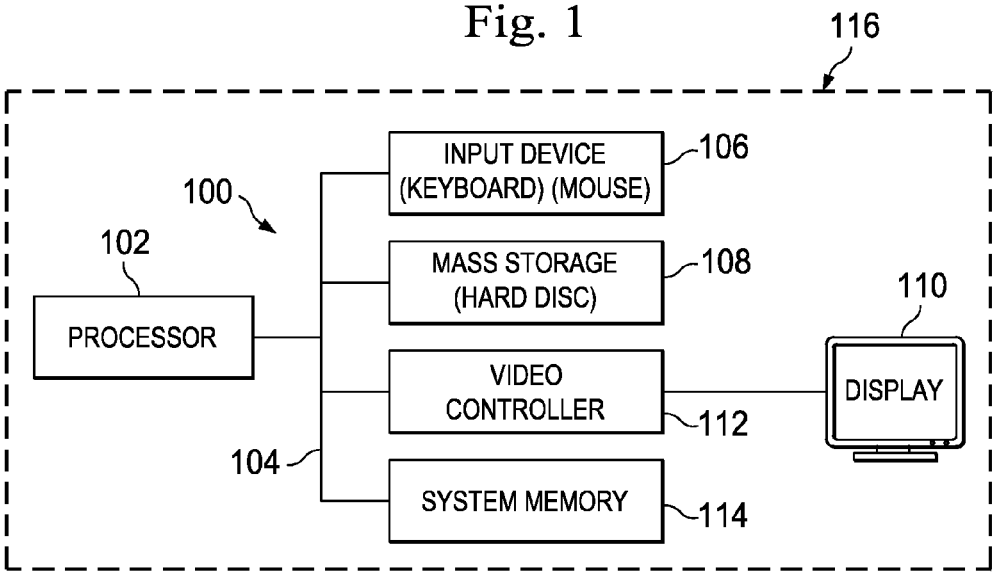
FIG. 1 is a schematic view illustrating an embodiment of an IHS.

In one embodiment, IHS 100, FIG. 1, includes a processor 102, which is connected to a bus 104. Bus 104 serves as a connection between processor 102 and other components of computer system 100. An input device 106 is coupled to processor 102 to provide input to processor 102. Examples of input devices include keyboards, touchscreens, and pointing devices such as mouses, trackballs and trackpads. Programs and data are stored on a mass storage device 108, which is coupled to processor 102. Mass storage devices include such devices as hard disks, optical disks, magneto-optical drives, floppy drives and the like. IHS 100 further includes a display 110, which is coupled to processor 102 by a video controller 112. A system memory 114 is coupled to processor 102 to provide the processor with fast storage to facilitate execution of computer programs by processor 102. In an embodiment, a chassis 116 houses some or all of the components of IHS 100. It should be understood that other buses and intermediate circuits can be deployed between the components described above and processor 102 to facilitate interconnection between the components and the processor 102.

Figure 2A:
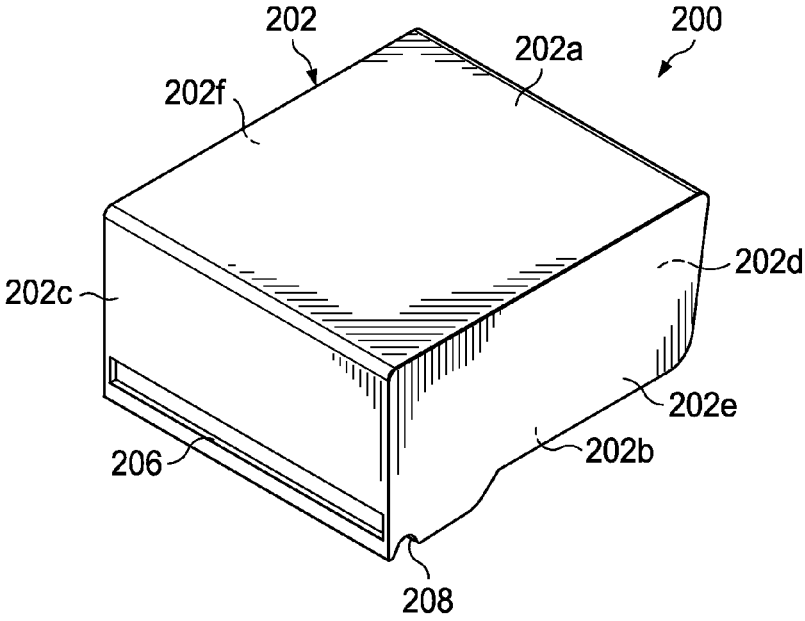
FIG. 2*a* is a perspective view illustrating an embodiment of a toner cartridge.
Figure 2B:
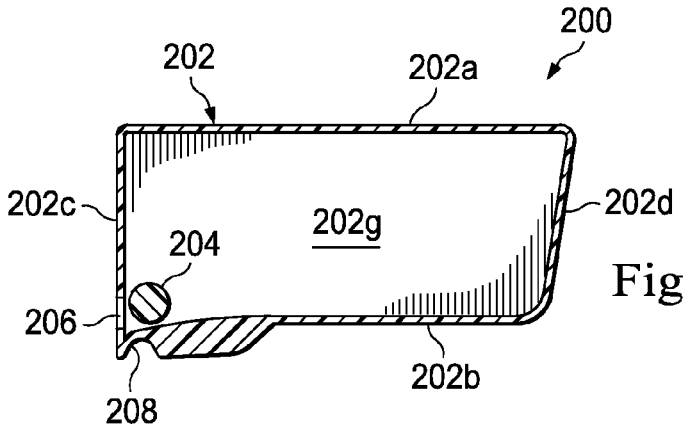
FIG. 2*b* is a cross sectional view illustrating an embodiment of the toner cartridge of FIG. 2*a*.

Referring now to FIGS. 2*a* and 2*b*, a toner cartridge 200 is illustrated. The toner cartridge 200 includes a base 202 having a top wall 202*a*, a bottom wall 202*b* located opposite the top wall 202*a*, a front wall 202*c* extending between the top wall 202*a* and the bottom wall 202*b*, a rear wall 202*d* located opposite the front wall 202*c* and extending between the top wall 202*a* and the bottom wall 202*b*, and a pair of opposing side walls 202*e* and 202*f* extending between the top wall 202*a*, the bottom wall 202*b*, the front wall 202*c*, and the rear wall 202*d*. A toner housing 202*g* is defined between the top wall 202*a*, the bottom wall 202*b*, the front wall 202*c*, the rear wall 202*d*, and the pair of opposing side walls 202*e* and 202*f*. A toner directing member 204 is located in the toner housing 202*g* adjacent the front wall 202*c* and the bottom wall 202*b*, and a toner outlet 206 is defined by the front wall 202*c* adjacent the toner directing member 204. In an embodiment, the toner directing member 204 and the toner outlet 206 includes structures and/or devices (not shown) for delivering toner for printing. A pivotal coupling 208 is located on the bottom wall 202*b* adjacent the front wall 202*c*.

Figure 3B:
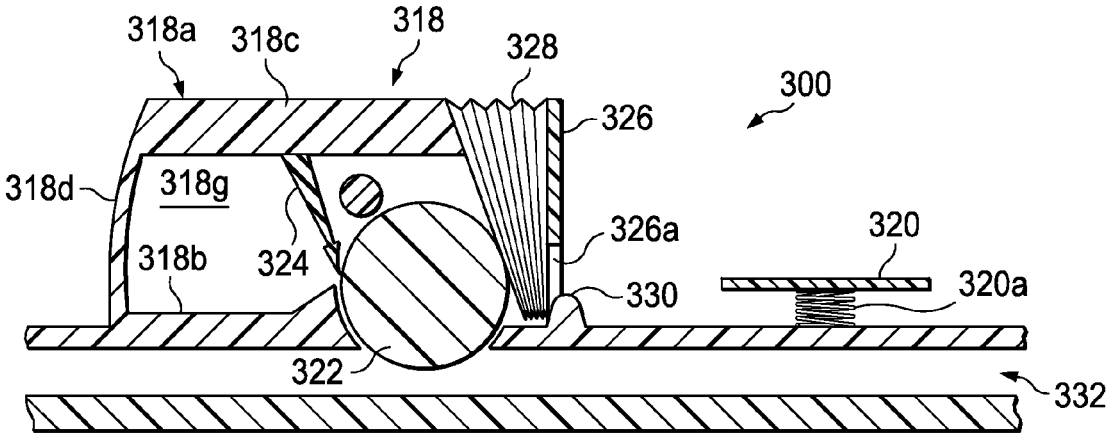
FIG. 3*b* is a cross sectional view illustrating an embodiment of the printer of FIG. 3*a*.
Figure 4A:
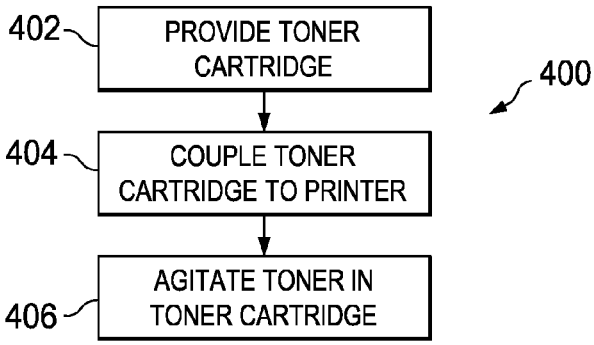
FIG. 4*a* is a flow chart illustrating an embodiment of a method to agitate toner in an toner cartridge.
Figure 3A:
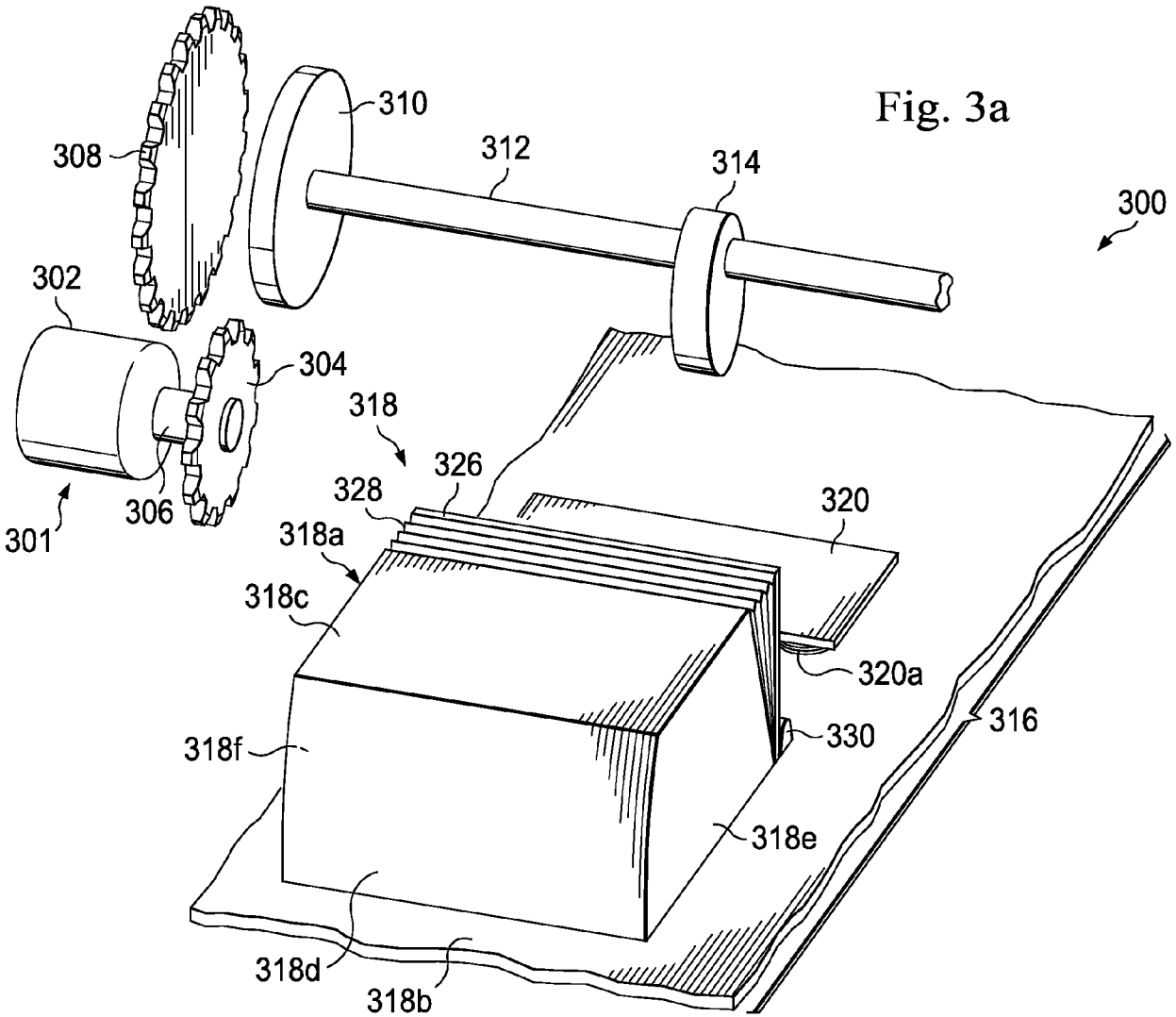
FIG. 3*a* is a partial internal view illustrating an embodiment of a printer used with the toner cartridge of FIGS. 2*a* and 2*b*.

Referring now to FIGS. 3*a* and 3*b*, a partial internal view of a printer 300 is illustrated. In an embodiment, the printer 300 may be coupled to, for example, the IHS 100, described above with reference to FIG. 1. In an embodiment, the printer 300 may include elements of the IHS 100 such as, for example, the processor 102, the input device 106, the storage 108, the display 110, the video controller 112, and/or the memory 114. In an embodiment, the printer 300 may be, for example, a laser printer. In an embodiment, the printer 300 may include a variety of conventional printer systems known in the art in addition to the system described below. In an embodiment, the portion of the printer 300 illustrated in FIG. 3 is located internally in a printer housing and includes an actuator 301 that, in an embodiment, includes a motor 302 that is coupled to a gear 304 by a shaft 306. In an embodiment, the actuator 301 may be used to actuate another device in the printer 300 other than the toner agitation system described below such as, for example, a paper path gear and/or other motor driven devices in the printer 300. A clutch mechanism 308 is located adjacent the gear 304. A clutch plate 310 is located adjacent the clutch mechanism 308 and includes a shaft 312 that extends from the clutch plate 310. In an embodiment, the clutch mechanism 308 is moveable relative to the gear 304 and the clutch plate 310 such that it may be in engagement with both the gear 304 and the clutch plate 310 at the same time. A toner agitation member 314 is coupled to the shaft 312. In the illustrated embodiment, the toner agitation member 314 is an eccentric cam that includes a disc that is coupled to the shaft 312 at a location on the disc that is not the center of rotation of the disc and, as such, rotation of the shaft 312 will rotate the disc such that a surface that is in constant engagement with a surface on the disc during its rotation will experience a constant and repetitively reversing linear motion. In an embodiment, the eccentric cam may be fabricated with a particular diameter, coupled to the shaft 312 at a location on the cam to produce a particular eccentricity, and rotated at a speed to provide an amplitude and frequency of vibration transmitted to a toner cartridge (described in further detail below) that achieves optimal agitation of toner in the toner cartridge 200. A toner cartridge coupling section 316 is located adjacent the toner agitation member 314 and includes a cleaner member 318 and a biasing member 320 that is resiliently biased towards the toner agitation member 314 by at least one resilient member 320*a*. In an embodiment, the cleaner member 318 includes a base 318*a* having a bottom wall 318*b*, a top wall 318*c* located opposite the bottom wall 318*b*, a front wall 318*d* extending between the bottom wall 318*b* and the top wall 318*c*, and a pair of opposing side walls 318*e* and 318*f* extending between the bottom wall 318*b*, the top wall 318*c*, and the front wall 318*d*. A residual toner housing 318*g* is defined by the base 318*a* between the bottom wall 318*b*, the top wall 318*c*, the front wall 318*d*, and the side walls 318*e* and 318*f*. A drum 322 is partially located in the residual toner housing 318*g* and a toner removal member 324 extends from the top wall 318*c* to a location adjacent the drum 322. A cartridge coupling member 326 that defines a toner entrance 326*a* is coupled to the base 318*a* of the cleaner member 318 by a flexible material 328 that extends between the base 318*a* and the cartridge coupling member 326. In an embodiment, the cartridge coupling member 326 is moveably coupled to the cleaner member 318 and/or a portion of the toner cartridge coupling section 316. In an embodiment, the cartridge coupling member 326 includes features (not shown) to secure a toner cartridge to the cartridge coupling member 326. A pivotal coupling 330 is located adjacent the cleaner member 318 and the drum 320. A paper passageway 332 is located adjacent the drum 322.

Figure 4B:
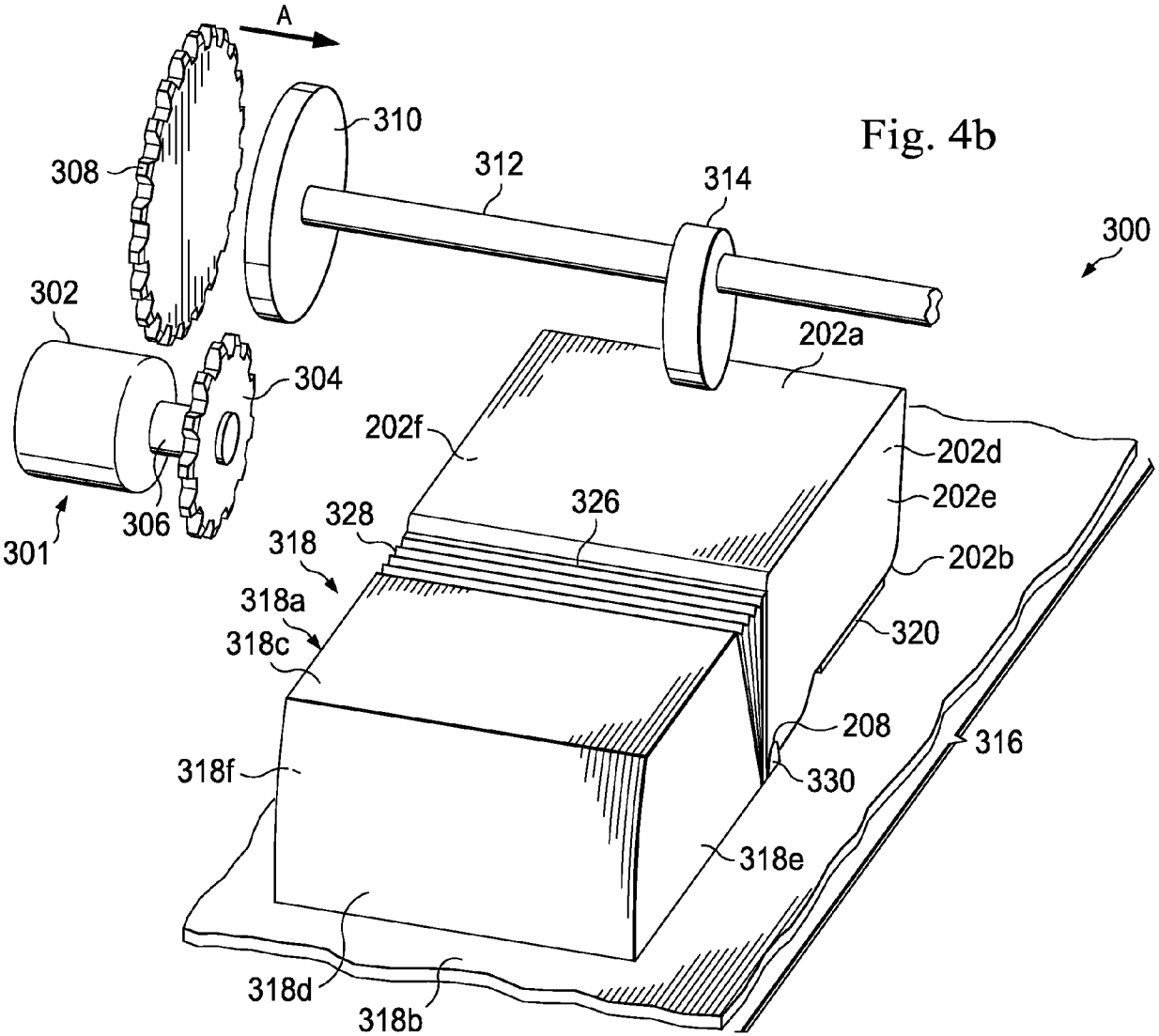
FIG. 4*b* is a perspective view illustrating an embodiment of the toner cartridge of FIGS. 2*a* and 2*b* coupled to the printer of FIG. 3.
Figure 4C:
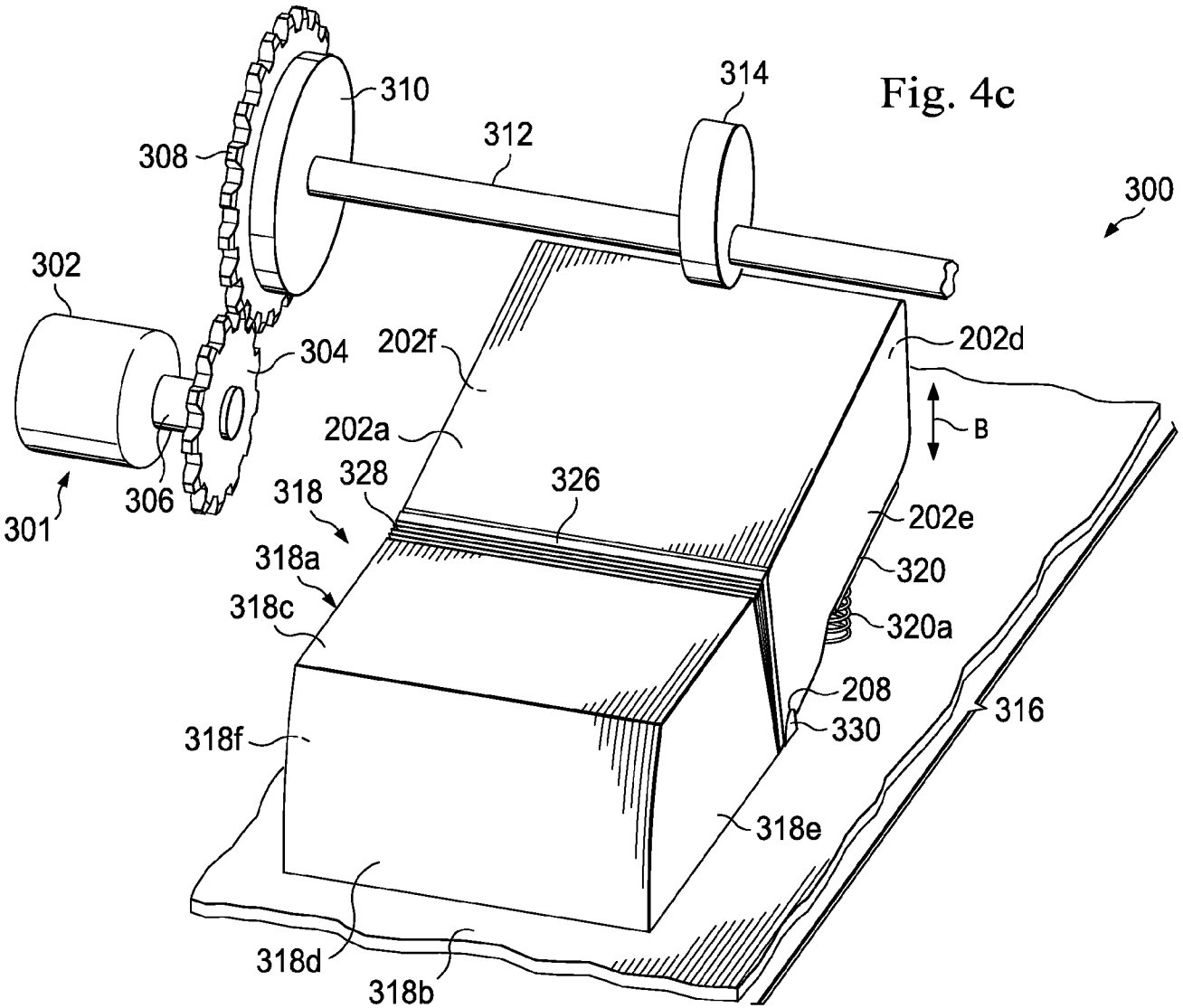
FIG. 4*c* is a perspective view illustrating an embodiment of the toner cartridge of FIGS. 2*a* and 2*b* coupled to the printer of FIG. 3 with the toner in the toner cartridge being agitated.
Figure 4D:
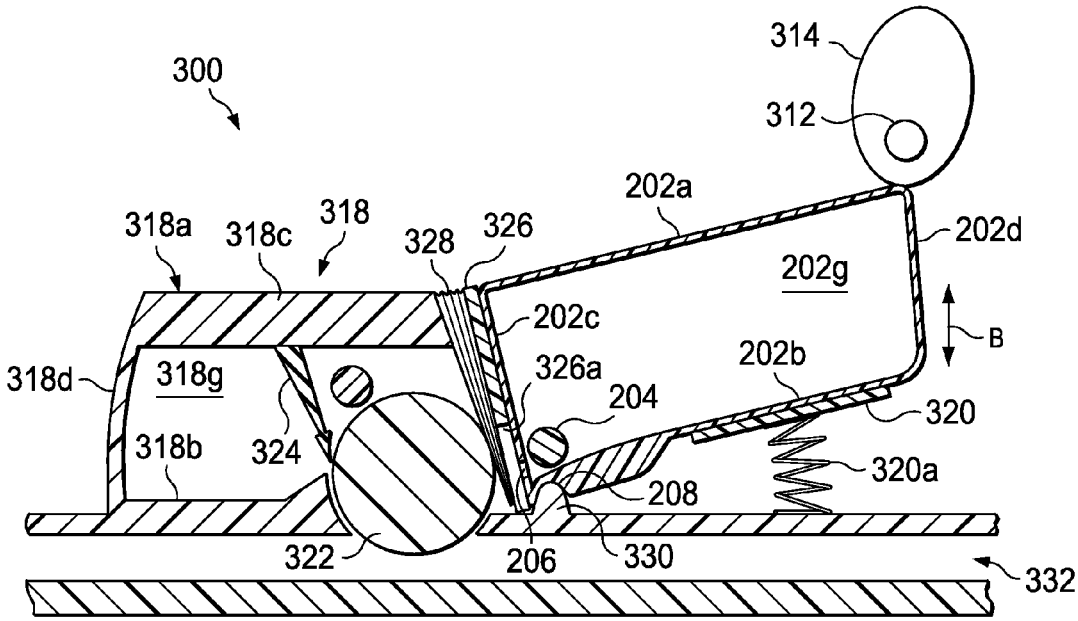
FIG. 4*d* is a cross sectional view illustrating an embodiment of the toner cartridge of 4*c*.

Referring now to FIGS. 2*a*, 2*b*, 3*a*, 3*b*, 4*a*, 4*b*, 4*c* and 4*d*, a method 400 to agitate toner in a toner cartridge is illustrated. The method 400 begins at block 402 where the toner cartridge 200 is provided. The toner cartridge 200 includes toner, not illustrated, in the toner housing 202*g*. The method 400 then proceeds to block 404 where the toner cartridge 200 is coupled to the printer 300. The toner cartridge 200 is positioned in the toner cartridge coupling section 316 of the printer 300 such that the toner cartridge 200 engages the cartridge coupling member 326 to secure the toner cartridge 200 to the printer 300, and the pivotal coupling 208 on the toner cartridge 200 engages the pivotal coupling 330 on the toner cartridge coupling section 316 to provide a moveable, pivotal coupling of the toner cartridge 200 to the printer 300. In an embodiment, with the toner cartridge 200 secured to the cartridge coupling member 326, the toner outlet 206 on the toner cartridge 200 is aligned with the toner entrance 326*a* on the cartridge coupling member 326 in order to allow the delivering of toner in the toner cartridge 200 to the drum 322. In an embodiment, with the toner cartridge 200 secured to the cartridge coupling member 326, the bottom wall 202*b* of the toner cartridge 200 engages the biasing member 320, and the top wall 202*a* of the toner cartridge 200 engages the toner agitation member 314, as illustrated in FIG. 4*b*. In an embodiment, the engagement of the bottom wall 202*b* of the toner cartridge 200 with the biasing member 320 biases the toner cartridge 200 towards the toner agitation member 314. The method 400 then proceeds to block 406 where toner in the toner cartridge 200 is agitated. The clutch mechanism 308 may be moved in a direction A, using methods known in the art, to engage the gear 304 and the clutch plate 310. Activation of the motor 302 rotates the shaft 306 and turns the gear 304. Due to the engagement of the clutch mechanism 308 and the gear 304, the turning of the gear 304 turns the clutch mechanism 308. Due to the frictional engagement of the clutch mechanism 308 and the clutch plate 310, the turning of the clutch mechanism 308 rotates the clutch plate 310, the shaft 312, and the toner agitation member 314. Rotation of the toner agitation member 314 causes the toner cartridge 200 to move back and forth along a direction B, illustrated in FIGS. 4*c* and 4*d*, due to the engagement of the toner agitation member 314 with a surface on the top wall 202*a* of the toner cartridge 200. The movement of the toner cartridge 200 results in any toner located in the toner housing 202*g* being directed towards the toner outlet 206. Use of the toner in the toner cartridge 200 to print may result in an uneven flow and distribution of toner in the toner housing 202*g* and available toner may be unable to reach the toner outlet 206. By agitating the toner, as described above, the toner is moved towards the toner outlet 206 such that it may be used to print. In an embodiment, the agitation of the toner may be manually initiated by a user or automatically enabled by, for example, the processor 102 on the IHS 100, described above with reference to FIG. 1, that is coupled to the printer 300 or a processor located in the printer 300 itself. In an embodiment, a printer controller (not shown) coupled to the printer 300 may be triggered to invoke a specific service routine to agitate the toner cartridge 200. For example, an optical density sensor may detect when toner is running low and then initiate the agitation of the toner, or toner agitation may be performed at certain time intervals or after the printer has been used to print. With the toner directed towards the toner outlet 206, the toner directing member 204 may be used to direct the toner out of the toner outlet 206 and through the toner entrance 326*a* to the drum 322. The drum 322 may then be used to deliver toner to paper that is moved adjacent to the drum 322 in the paper passageway 332.

Figure 5A:
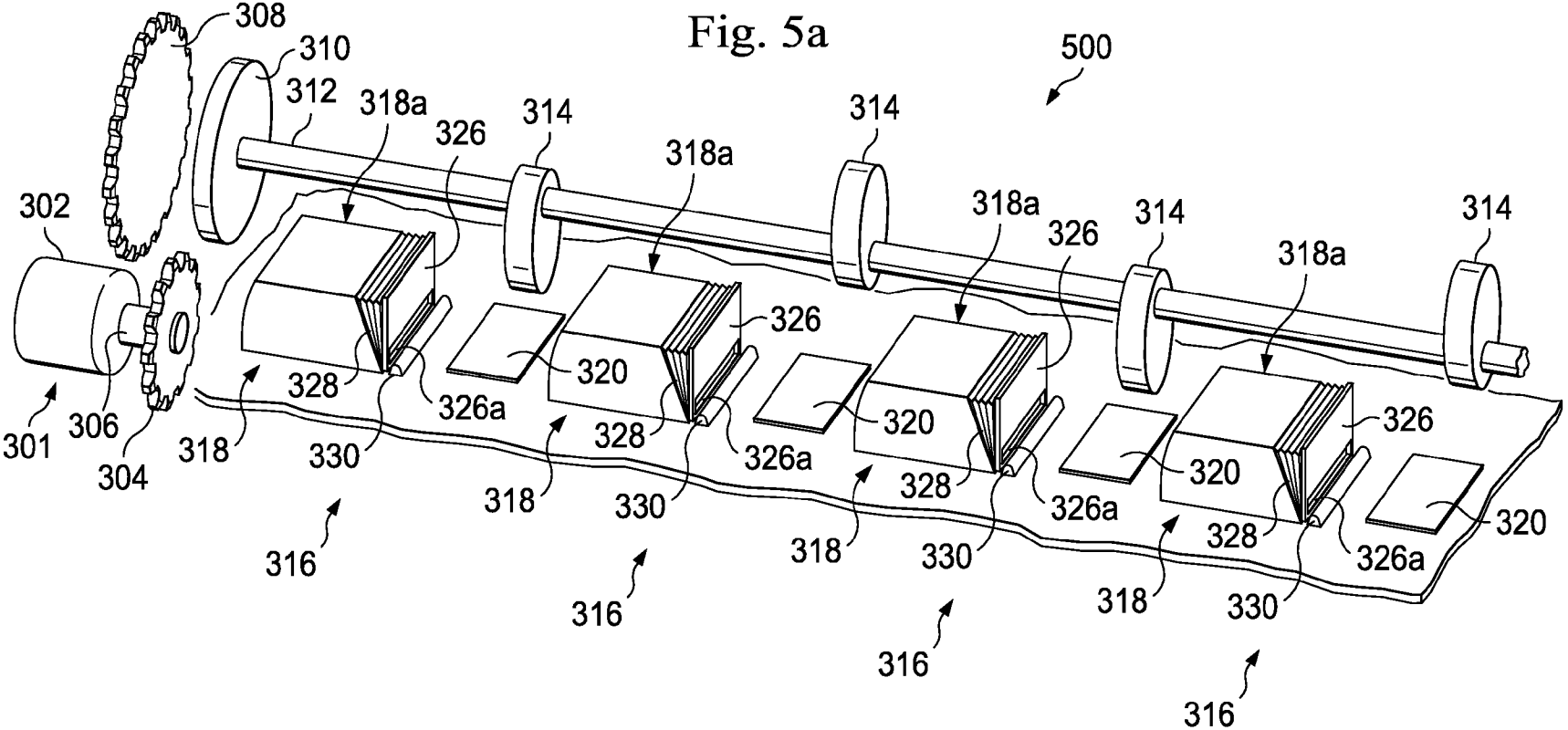
FIG. 5*a* is a partial internal view illustrating an embodiment of a printer used with the toner cartridge of FIGS. 2*a* and 2*b*.
Figure 5B:
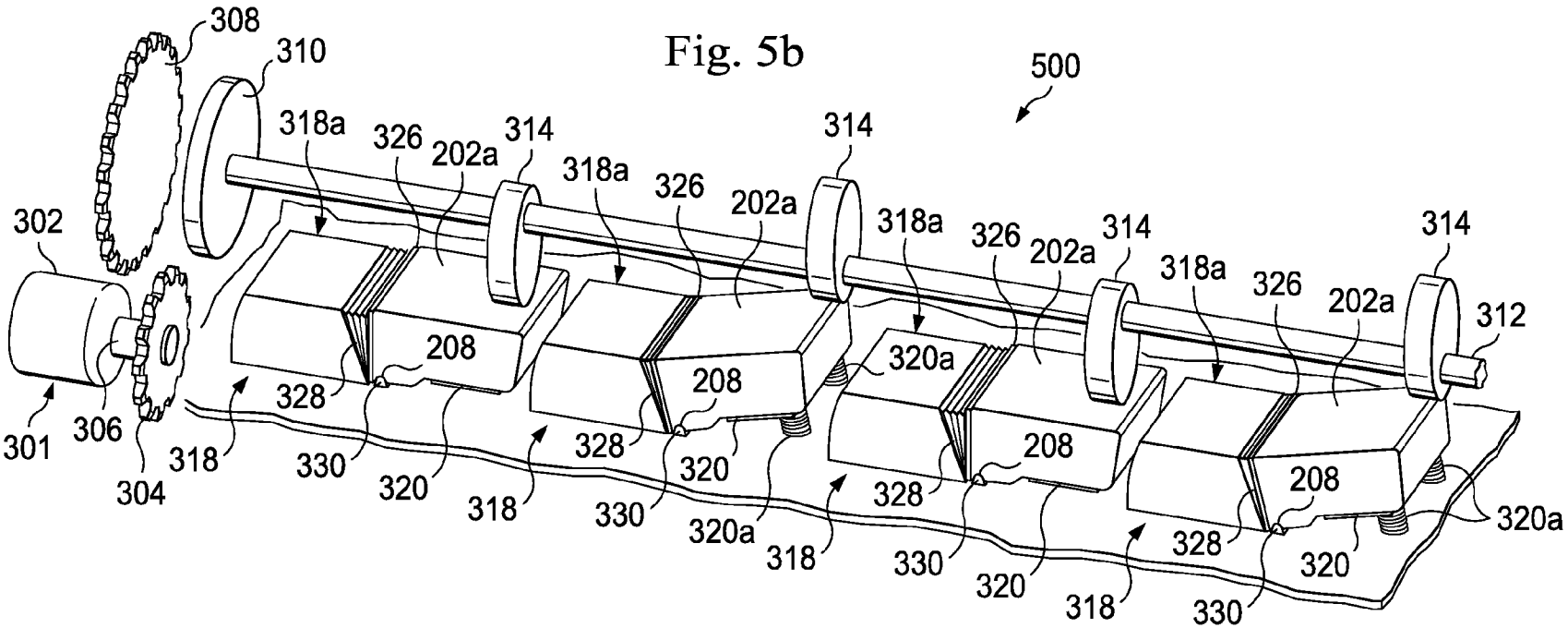
FIG. 5*b* is a perspective view illustrating an embodiment of a plurality of the toner cartridges of FIGS. 2*a* and 2*b* coupled to the printer of FIG. 5*a* with the toner in the toner cartridges being agitated.

Referring now to FIGS. 2*a*, 2*b*, 5*a* and 5*b*, in an embodiment, a printer 500 is substantially similar in structure and operation to the printer 300, described above with reference to FIGS. 3*a* and 3*b*, with the provision of a plurality of toner agitation members 314 located on the shaft 312 in a spaced apart relationship from each other, and a plurality of toner cartridge coupling sections 316 located adjacent each other in a spaced apart relationship such that each toner cartridge coupling section 316 is adjacent a corresponding toner agitation member 314 and each toner cartridge coupling section 316 is rotated approximately 90 degrees from the orientation illustrated in FIG. 3*a*, as illustrated in FIG. 5*a*. In operation, a toner cartridge 200 may be secured to each toner cartridge coupling section 316 of the printer 500 in substantially the same manner as described above for the printer 300, and the toner in each of the toner cartridges 200 may be agitated in substantially the same manner as described above for the printer 300, illustrated in FIG. 5*b*.

Figure 6A:
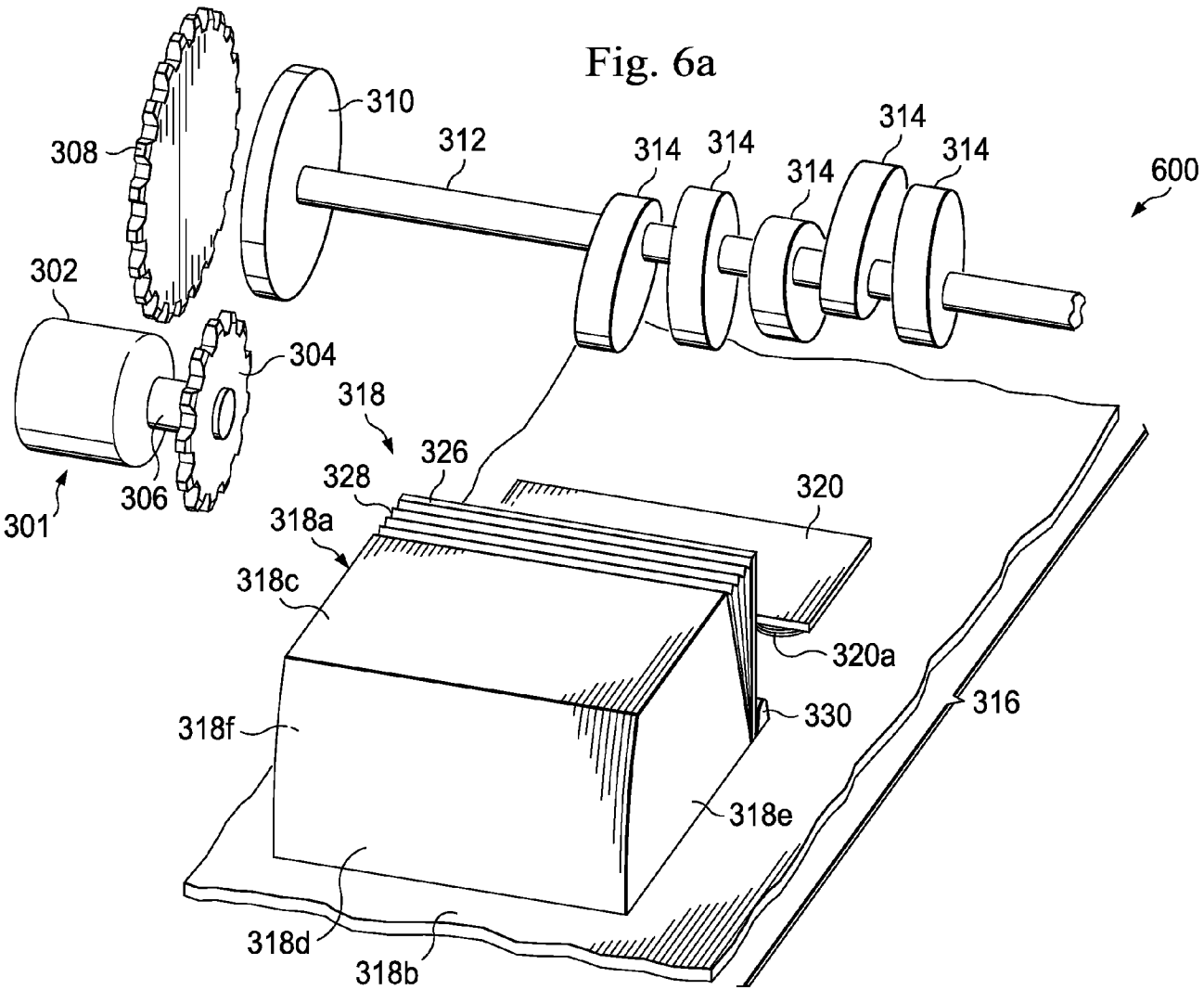
FIG. 6*a* is a partial internal view illustrating an embodiment of a printer used with the toner cartridge of FIGS. 2*a* and 2*b*.
Figure 6B:
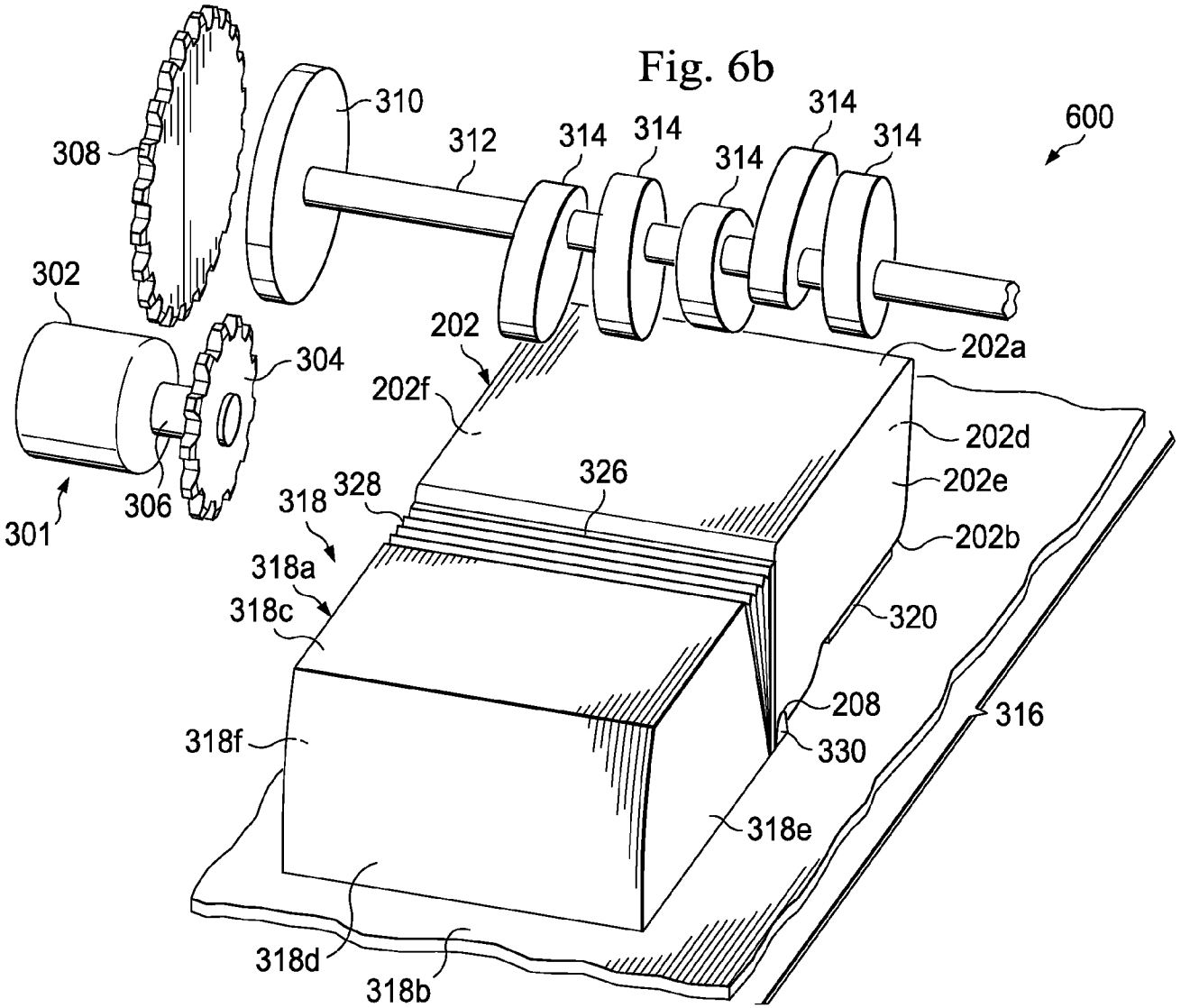
FIG. 6*b* is a perspective view illustrating an embodiment of the toner cartridge of FIGS. 2*a* and 2*b* coupled to the printer of FIG. 6*a* with the toner in the toner cartridge being agitated.

Referring now to FIGS. 2*a*, 2*b*, 6*a* and 6*b*, in an embodiment, a printer 600 is substantially similar in structure and operation to the printer 300, described above with reference to FIGS. 3*a* and 3*b*, with the provision of a plurality of toner agitation members 314 located on the shaft 312 in a spaced apart relationship from each other, with all the toner agitation members 314 adjacent the toner cartridge coupling section 316, as illustrated in FIG. 6*a*. In operation, a toner cartridge 200 may be secured to the toner cartridge coupling section 316 of the printer 600 in substantially the same manner as described above for the printer 300. The toner in the toner cartridge 200 may be agitated substantially similarly as described above for the printer 300, with the provision of the plurality of toner agitation members 314 engaging a surface of the top wall 202*a* of the toner cartridge 200 in order to move the toner cartridge 200 relative to the printer 600.

Figure 7A:
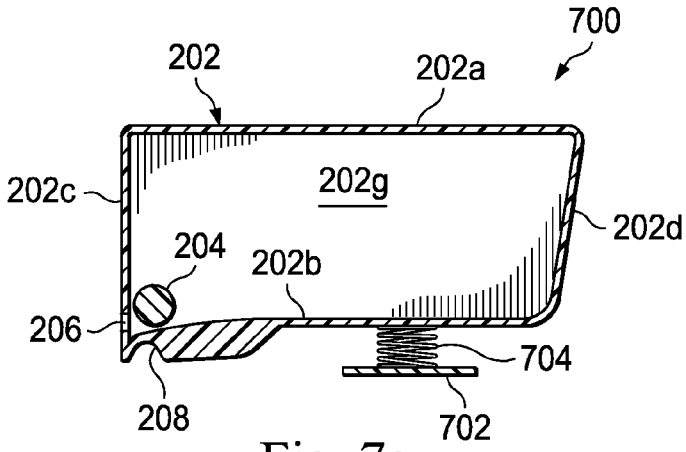
FIG. 7*a* is a cross sectional view illustrating an embodiment of a toner cartridge.
Figure 7B:
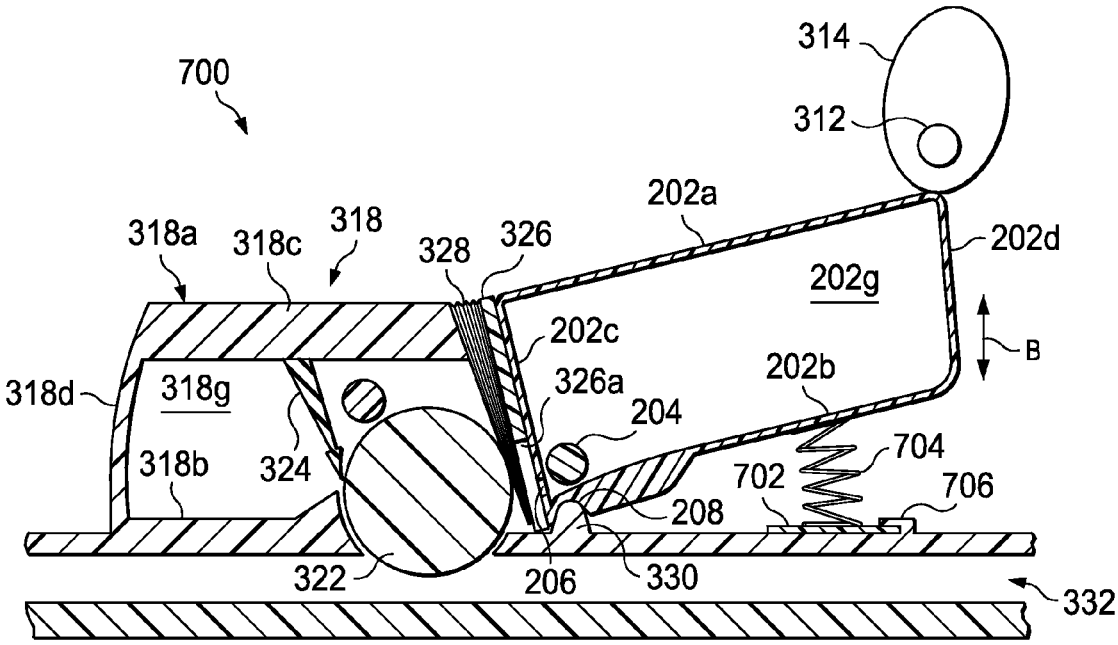
FIG. 7*b* is a cross sectional view illustrating an embodiment of the toner cartridge of FIG. 7*a* coupled to a printer.

Referring now to FIGS. 7*a* and 7*b*, in an embodiment, a toner cartridge 700 is substantially similar in structure and operation to the toner cartridge 200, described above with reference to FIGS. 2*a* and 2*b*, with the provision of a biasing member 702 coupled to the bottom wall 202*b* of the toner cartridge 200 by a resilient member 704, as illustrated in FIG. 7*a*. In operation, the toner cartridge 700 may be secured to a toner cartridge coupling section that is substantially similar to the toner cartridge coupling section 316, described above with reference to FIGS. 3*a* and 3*b*, with the provision of a biasing member securing device 706. With the toner cartridge 700 secured to the toner cartridge coupling section, the resilient member 704 may bias the toner cartridge 700 towards the toner agitation member 314, as illustrated in FIG. 7*b*. Thus, a system and method are provided that agitate toner in a toner cartridge without the need for user intervention.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A printer, comprising:

a toner cartridge coupling section including a base that defines a housing that houses at least a portion of a drum, and including a cartridge coupling member that defines a toner entrance, wherein the cartridge coupling member is coupled to the base by a flexible material that provides an enclosed passageway between the toner entrance and the housing;

a pivotal coupling located adjacent the cartridge coupling member;

a toner agitation member located adjacent the toner cartridge coupling section, wherein the toner agitation member is operable to engage a surface of a toner cartridge when the toner cartridge engages the cartridge coupling member and is pivotally coupled to the pivotal coupling;

a biasing member that is operable to bias the toner cartridge towards the toner agitation member; and an actuator that is operable to actuate the toner agitation member.

2. The printer of claim 1, further comprising:

a paper passageway located adjacent the drum.

3. The printer of claim 1, wherein the toner agitation member comprises an eccentric cam.

4. The printer of claim 1, further comprising:

a shaft coupling the actuator to the toner agitation member.

5. The printer of claim 1, wherein the actuator is also operable to actuate a paper path gear in the printer.

6. The printer of claim 1, further comprising:

a plurality of the toner agitation members located adjacent the toner cartridge coupling section, wherein the plurality of toner agitation members are operable to engage a surface of a toner cartridge when the toner cartridge engages the cartridge coupling member and is pivotally coupled to the pivotal coupling.

7. The printer of claim 1, further comprising:

a toner cartridge located in the toner cartridge coupling section and coupled to the printer.

8. The printer of claim 7, wherein the toner cartridge engages the cartridge coupling member to secure the toner cartridge to the printer.

9. The printer of claim 8, wherein the toner cartridge engages the pivotal coupling to provide a moveable, pivotal coupling of the toner cartridge to the printer.

10. The printer of claim 9, wherein the biasing member engages a first surface of the toner cartridge to bias the toner cartridge towards the toner agitation member such that a second surface of the toner cartridge engages the toner agitation member.

11. The printer of claim 10, wherein the biasing member biases the toner cartridge along a range of motion of the pivotal coupling and towards the toner agitation member.

12. A printer comprising:

a plurality of toner cartridge coupling sections;

a toner agitation member located adjacent each of the toner cartridge coupling sections, wherein each of the toner agitation members are operable to engage a surface of a respective toner cartridge when that respective toner cartridge is located in the corresponding toner cartridge coupling section; and an actuator that is operable to actuate each of the toner agitation members.

13. The printer of claim 12, wherein each of the toner cartridge coupling sections comprise a biasing member that is operable to bias a section of a toner cartridge towards the corresponding toner agitation member.

14. The printer of claim 12, further comprising:

a shaft coupling the actuator to the plurality of toner agitation members.

15. An information handling system, comprising:

a processor a memory coupled to the processor; and a printer coupled to the processor, wherein the printer comprises:

a toner cartridge coupling section including a base that defines a housing that houses at least a portion of a drum, and including a cartridge coupling member that defines a toner entrance, wherein the cartridge coupling member is coupled to the base by a flexible material that provides an enclosed passageway between the toner entrance and the housing;

a pivotal coupling located adjacent the cartridge coupling member;

a toner agitation member located adjacent the toner cartridge coupling section;

a biasing member located adjacent the toner agitation member;

an actuator that is operable to actuate a paper path gear in the printer and that is also operable to actuate the toner agitation member; and a toner cartridge that engages the cartridge coupling member and is pivotally coupled to the pivotal coupling, wherein the toner agitation engages a first surface of the toner cartridge and the biasing member engages a second surface of the toner cartridge to bias the toner cartridge towards the toner agitation member.

16. The cartridge of claim 15, further comprising:

a paper passageway located adjacent the drum.

17. A method to agitate toner in a toner cartridge, comprising:

providing a toner cartridge coupling section including a base that defines a housing that houses at least a portion of a drum, and including a cartridge coupling member that defines a toner entrance, wherein the cartridge coupling member is coupled to the base by a flexible material that provides an enclosed passageway between the toner entrance and the housing;

pivotally coupling the toner cartridge to a pivotal coupling that is located adjacent the cartridge coupling section and engaging the toner cartridge with the cartridge coupling section;

engaging the toner cartridge with a biasing member, wherein the biasing member biases the toner cartridge into engagement with a toner agitation member; and actuating an actuator that is coupled to the toner actuation member in order to move the toner cartridge along a range of pivotal motion and agitate toner in the toner cartridge.

18. The method of claim 17, further comprising:

actuating a paper path gear with the actuator.

19. The method of claim 17, further comprising:

moving paper through a paper passageway that is located adjacent the drum.

20. The method of claim 17, wherein the actuating the actuator is performed in response to detecting that a toner level is low.

* * * * *